US006466682B2

(12) United States Patent
An

(10) Patent No.: US 6,466,682 B2
(45) Date of Patent: Oct. 15, 2002

(54) VIBRATION SPEAKER

(75) Inventor: Sang Gil An, Suwon (KR)

(73) Assignee: Samsung Electro-Mechanics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/893,173

(22) Filed: Jun. 27, 2001

(65) Prior Publication Data

US 2002/0122560 A1 Sep. 5, 2002

(30) Foreign Application Priority Data

Mar. 2, 2001 (KR) ..... 2001-10832

(51) Int. Cl.[7] ..... H04R 25/00
(52) U.S. Cl. ..... 381/413; 381/396; 381/412
(58) Field of Search ..... 381/396, 150, 381/412, 413, 398, 404, 411; 340/388.1, 311.1

(56) References Cited

U.S. PATENT DOCUMENTS 5,829,319 A * 11/1998 Mokeddem
6,211,775 B1 * 4/2001 Lee et al.

FOREIGN PATENT DOCUMENTS

WO WO 98/49460 * 11/1998

* cited by examiner

*Primary Examiner*—Sinh Tran
(74) *Attorney, Agent, or Firm*—Darby & Darby

(57) ABSTRACT

Disclosed is a vibration speaker capable of transferring a stable vibratory force to a set including the vibration speaker for eliminating a touch sound of a vibrating mass and generating a minimum vibrating force during vibration by expanding inputted frequency bandwidth. The vibration speaker according to the invention includes a case having a space on an inner surface thereof, a vibrating plate having an external tip fixed onto an upper end portion of the case for generating a sound, a voice coil wound and fixed onto a lower end of the vibrating plate in a cylindrical shape, a plate having an external end portion fixed onto a lower end portion of the case, a magnetic circuit provided on a lower portion of the voice coil to include a magnet seated in a vertical direction, an upper plate and a yoke attached to the magnet for forming a magnetic field, a weight of a cylindrical shape fixed onto an external peripheral surface of the yoke, suspension springs fixed onto an internal peripheral surface of the case for suspending the magnetic circuit and the weight, and a magneto-rheological fluid having a predetermined degree of viscosity arranged between the magnetic circuit and the plate to function as a damping member while the suspension springs are displaced in a vertical direction.

4 Claims, 3 Drawing Sheets

VIBRATION SPEAKER

BACKGROUND OF THE INVENTION

1. Field of the Invention

The present invention relates to a vibration speaker used in mobile communication terminals including cellular phones and pagers for simultaneously generating a sound and a vibration, and in particular, to transferring a stable vibratory force to a set including a vibration speaker for eliminating a touch sound of a vibrating mass and generating a minimum vibrating force during vibration by expanding inputted frequency bandwidth.

The general principle of generating vibration in a vibration speaker used for cellular phones, pagers, etc. is to use a resonance frequency of a vibration system inside of the vibration speaker.

In this regard, the vibrating mass inside of the vibration speaker performs a vertical movement, and touching phenomenon occurs when the vibration mass collides with objects in the upward and downward directions in accordance with the intensity or frequency of inputted vibration signals. Therefore, certain limitations need to be laid on intensity and frequency of the inputted vibration signals when using the vibration speaker as a vibration generator so as not to cause the touching phenomenon in the upward and downward directions.

FIG. 1 is a cross-sectional view of a conventional vibration speaker. Referring to FIG. 1, the conventional vibration speaker comprises a case 8 having an inner space, a magnet 4 and a voice coil 2 housed in the case 8, and a vibrating plate 1 for generating a sound.

In the conventional vibration speaker constructed above as shown in FIG. 2, electromagnetic force is generated if an alternated current, which is a high frequency, is applied to the voice coil 2 within a magnetic field consisting of an upper plate 3, the magnet 4 seated in a vertical direction, and a yoke 5 through a lead wire (not shown in FIG. 2) from outside. The voice coil 2 performs a vertical movement due to the generated electromagnetic force. At this stage, a sound is generated by a fine vibration of the vibrating plate 1, to which a tip of the voice coil 2 is attached.

Also, if a low frequency signal (preferably of 100–200 Hz) as shown in the left part of FIG. 2 is applied to the voice coil 2, a vibration is generated by triggering a vertical movement of the vibrating mass including the weight 6 and parts constituting the magnetic field suspended on an upper suspension spring 7 and a lower suspension spring 9.

The amount of movement of the vibrating mass varies according to the intensity and frequency of the inputted low frequency signals for generating a vibration. Here, touching phenomenon occurs such that the vibrating mass collides with the vibrating plate 1 and the voice coil 2 at the upper side and other attachments at the lower side.

To limit the vertical movement of the vibrating mass for protecting the collided objects from the touching phenomenon, a stopper structure 6*a* that can limit the vertical displacement is included in the vibrating mass. Finger stops 8*a*, 9*b* are installed at upper and lower sides of the inner wall surface of the case facing the stopper structure 6*a*.

Even if the stopper 6*a* and the finger stops 8*a*, 8*b* may be able to protect major parts, the touching phenomenon per se cannot be prevented due to the stopper 6*a*, and the touching noise is still generated.

Therefore, to prevent the touching phenomenon of the vibrating mass and the noise caused thereby, it is critical to limit the intensity and frequency width of the signals inputted to the voice coil 2, etc.

In other words, as the intensity and the frequency bandwidth of the input signals for generating a vibration, which affect the amplitude of the vibrating mass, should prevent the touching phenomenon and the accompanying noise while satisfying the minimum function of incoming calls, the intensity and the frequency need to be limited.

This means that the amplitude and the inputted frequency bandwidth are determined according to the vibrating characteristics of a product itself constituting the vibration system with the mass and spring. Therefore, the inputted frequency is determined by the natural frequency of the vibration system ($\omega_n=2\pi f_n$), thereby affecting the amplitude of the vibrating mass.

FIG. 10A shows the conventional vibration speaker represented by a simplified vibration system. Assuming that the vibrating mass by the magnet 4, the yoke 5, the upper plate 3 and the weight 6 is simplified into "m", and that the suspension springs 7, 9 are simplified into a spring coefficient "k", the natural frequency of the vibration system constructed as above is determined by the values of "m" and "k" as follows.

$$\omega n=\sqrt{k/m}$$

Since the natural frequency forming the characteristics of the vibration system is affected by the initial conditions or amplitude, a strict management of the parts related to the vibrating characteristics is required when manufacturing the product in order to resolve the above problem caused by the touching phenomenon. The burden of the managing items is added when assembling the product, thereby increasing the unit cost. Ignorance of these factors results in a product of low quality.

SUMMARY OF THE INVENTION

It is, therefore, an object of the present invention to provide a vibration speaker used for mobile communication terminals including cellular phones and pagers that can transfer a stable vibrating force to a set, on which a device is mounted for eliminating a touch sound of a vibrating mass and generating a minimum vibrating force during vibration, by expanding inputted frequency bandwidth.

To achieve the above object, there is provided a vibration speaker for transferring a stable vibrating force to a set, on which a device is mounted for eliminating a touch sound of a vibrating mass and generating a minimum vibrating force during vibration, by expanding inputted frequency bandwidth, the speaker comprising: a case having a space on an inner wall surface; a vibrating plate fixed on an upper end portion of the case at an external tip thereof for generating a sound; a voice coil wound around the vibrating plate so that an upper end thereof can be fixed on the vibrating plate; a plate, an external tip of which is fixed onto a lower end portion of the case; a magnet seated in a vertical direction; an upper plate attached to the magnet for forming a magnetic field; a weight provided on a lower portion of the voice coil to constitute a vibrating mass together with a yoke; a suspension spring for suspending the vibrating mass; and a magneto-rheological fluid having a viscosity inside thereof.

As shown in FIG. 3, the magneto-rheological fluid is positioned between a yoke 15 and a plate 20. The magneto-rheological fluid is, as shown in FIG. 7, a fluid comprising fine magnetic particles 22 having magnetism, and a liquid 24 containing a surfactant 23 surrounding the magnetic particles 22 and oil. The magneto-rheological fluid 21 has characteristics of maintaining a consistent form if laid within the magnetic field of higher than a certain intensity so as not to flow out of or run over the rim. If the magnetic field is formed in the upper plate 13, the magnet 14, the yoke 15, etc. constituting the magnetic field, as shown in FIG. 7, the vibrating mass performs a vertical movement so that the cleft made with the plate 20, which is attached to the lower side of the upper plate 13, becomes narrow due to the vertical movement of the vibrating mass. Because of the facilitation of the magneto-rheological fluid 21 having viscosity as shown in FIGS. 3 and 4, the magneto-rheological fluid 21 is always placed between the vibrating mass and the attachment of the lower side.

The magneto-rheological fluid 21 placed between the vibrating mass and the attachment of the lower side functions as a kind of damper due to the viscosity of itself. The following is an explanation of the function.

FIG. 10B shows a vibrating modeling that simplifies the vibrating speaker according to the present invention. Compared with the conventional structure, FIG. 10B shows that the damper has been added due to the viscosity of the magneto-rheological fluid 21. The vibration system having a damper is affected by a damping force proportional to a velocity as well as by an elasticity of the spring and a gravity of the mass. Thus, the vibrating characteristics are varied as shown in FIG. 9. This means that, the movement of the vibrating system is variable in accordance with an amount of the damping, and the vibration is usually damped when the amount of damping increases compared with the case when no damping exists. In other words, the amplitude is reduced when the amount of damping increases.

As a consequence, no noise is generated owing to no occurrence of the touching phenomenon, and other kinds of noise is also drastically reduced. In terms of the characteristics of the frequency of the vibrating force generated by the vertical movement of the vibrating mass, the intensity of the input signals can also be increased more than the conventional case owing to an increased damping resulted from the viscosity of the magneto-rheological fluid. Thus, the bandwidth of the inputted frequency is widened.

The part identified by dotted lines in FIG. 9 represents the conventional structure, under which the bandwidth of the maximum frequency is narrow. On the other hand, the part identified by a solid line represents characteristics of the present invention having an amplified maximum frequency bandwidth. Therefore, the present invention is characterized in that desired vibrating characteristics can be acquired by preventing the conventional touching phenomenon with proper control of an amount of damping of the vibration system having a damper.

BRIEF DESCRIPTION OF THE DRAWINGS

The above objects, features and advantages of the present invention will become more apparent from the following detailed description when taken in conjunction with the accompanying drawings, in which.

DESCRIPTION OF THE PREFERRED EMBODIMENTS

Figure 1:
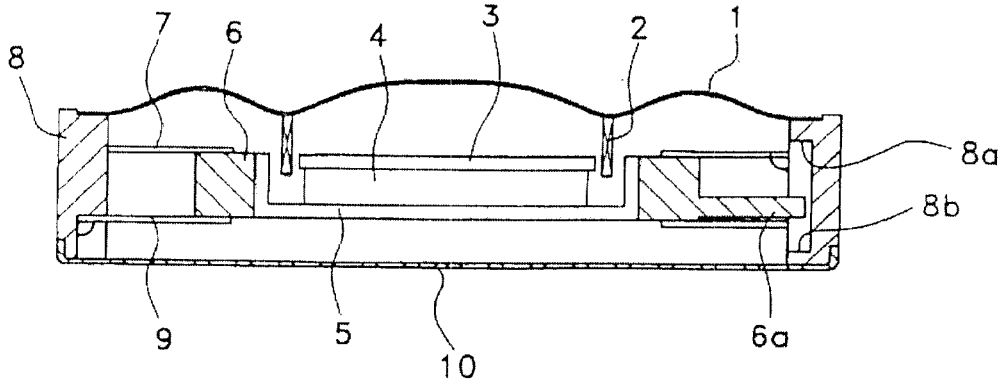
FIG. 1 PRIOR ART
FIG. 1 is a cross-sectional view of a conventional vibration speaker.

Preferred embodiments of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 3:
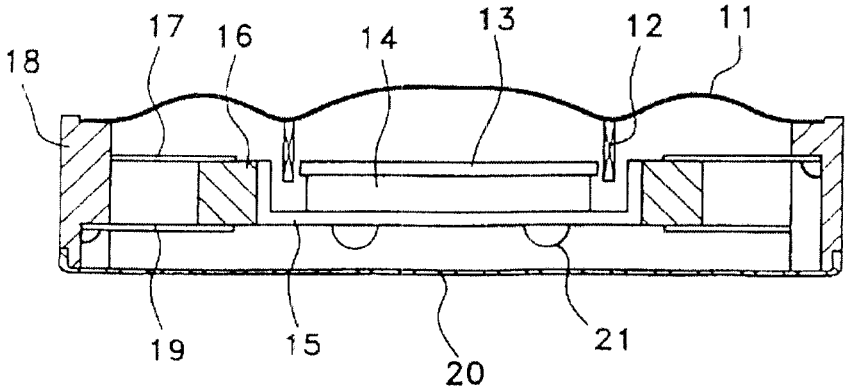
FIG. 3 is a cross-sectional view of a vibration speaker according to an embodiment of the present invention.

FIG. 3 shows a single coil for generating a sound and a vibration according to a preferred embodiment of the present invention. Referring to FIG. 3, when the magneto-rheological fluid has been added to the coil and a low frequency signal is inputted to generate a vibration, a stable vibration system is created without any touching phenomenon.

Figure 4:
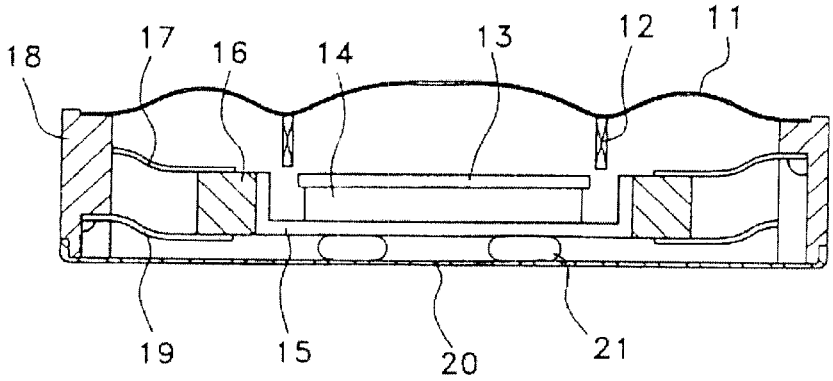
FIG. 4 is a cross-sectional view of a magneto-rheological fluid varying in accordance with a vertical movement of a vibrating mass according to an embodiment of the present invention.

An embodiment of the present invention will now be described with reference to FIGS. 3 and 4.

A vibration speaker comprises a case 18 having a space on an inner wall; a vibrating plate 11 fixed on an upper end portion of the case at an external tip thereof for generating a sound; a voice coil 12 wound around the vibrating plate 11 so that an upper end thereof can be fixed on the vibrating plate 11; a plate 20, an external tip of which is fixed onto a lower end portion of the case 18; a magnet 14 seated in a vertical direction; an upper plate 13 attached to the magnet 14 for forming a magnetic field; a magnetic circuit composed of an upper plate 13 and a yoke 15 for forming a magnetic field provided on a lower portion of the voice coil 12; a weight 16 fixed onto an outer surface of the yoke 15; suspension springs 17, 19 for suspending the vibrating mass; and a magneto-rheological fluid 21 having a predetermined degree of viscosity inside thereof arranged between the magnetic circuit and the plate 20 to function as a damping member when the suspension springs are displaced in a vertical direction.

An electromagnetic force is generated if an alternating current, which is a high frequency, is applied to the voice coil 12 inside of the magnetic field comprising the upper plate 13, the magnet 14 seated in a vertical direction, and the yoke 15 through a lead wire (not shown in the drawing).

Figure 2:
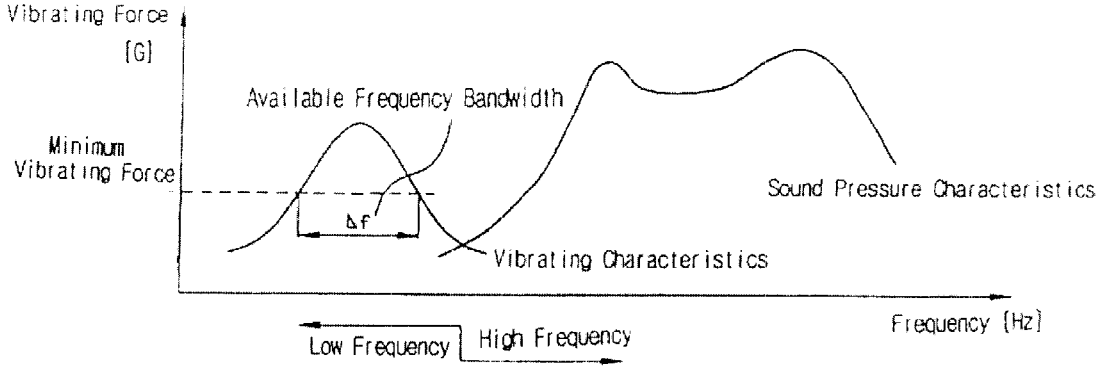
FIG. 2 PRIOR ART
FIG. 2 is a graph illustrating characteristics of the vibrating sound pressure in accordance with an inputted frequency in general.

A vibration is generated, if a low frequency signal (preferably of 100–200 Hz) is applied as shown on the left side of FIG. 2, to trigger a vertical movement of the vibrating mass including the parts constituting the magnetic field by being suspended on the suspension springs 17, 19 and the weight 16.

The magneto-rheological fluid 21 added during the vibration serves to prevent the touching phenomenon with a damping effect. This is because the magneto-rheological fluid 21 operates between the lower portion of the vibrating mass, and more precisely a lower surface of the yoke 15, and an object at a lower end of the case.

FIG. 3 is a configuration of coating the magneto-rheological fluid on the yoke 15. FIG. 4 is a configuration of the magneto-rheological fluid when a low frequency signal (preferably of 100–200 Hz) is applied and the vibrating mass suspended on the suspension springs 17, 19 is moving downward.

The vibrating speaker having a structure of separating the coil for generating a sound from the coil for generating a vibration according to another embodiment of the present invention will now be described in detail with reference to FIGS. 5 and 6.

The vibration speaker comprises a case 38 having an inner space, a magnet 34 and a voice coil 32 housed inside of the case 38, a vibrating plate 31 for ultimately generating a sound, and a coil for generating a vibration. An electromagnetic force is generated if an alternating current, which is a high frequency, is applied to the voice coil 32 inside of the magnetic field comprising the upper plate 33, the magnet 34 seated in a vertical direction, and the yoke 35 through a lead wire (not shown in the drawings).

A vibration is generated, if a low frequency signal is applied. The voice coil 32 moves in a vertical direction due to the generated electromagnetic force. A sound is generated by a fine vibration of the vibrating plate 31, to which a tip of the voice coil 32 is attached.

Also, a low frequency signal (preferably of 100–200 Hz) applied to a coil 45 for generating a vibration triggers a vertical movement of the vibrating mass suspended on the suspension springs 37, 39.

Figure 5:
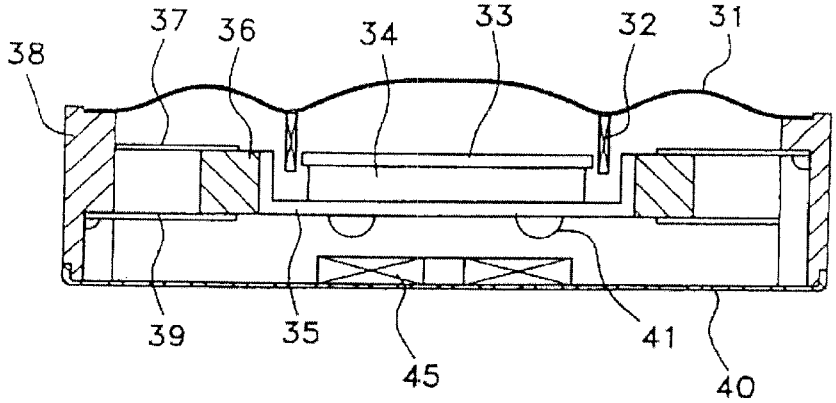
FIG. 5 is a cross-sectional view of a vibration speaker according to another embodiment of the present invention.
Figure 6:
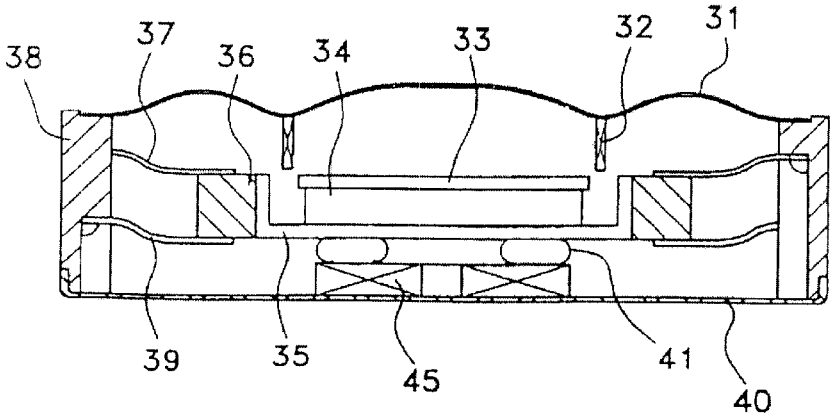
FIG. 6 is a cross-sectional view of a magneto-rheological fluid varying in accordance with a vertical movement of a vibrating mass according to another embodiment of the present invention.
Figure 7:
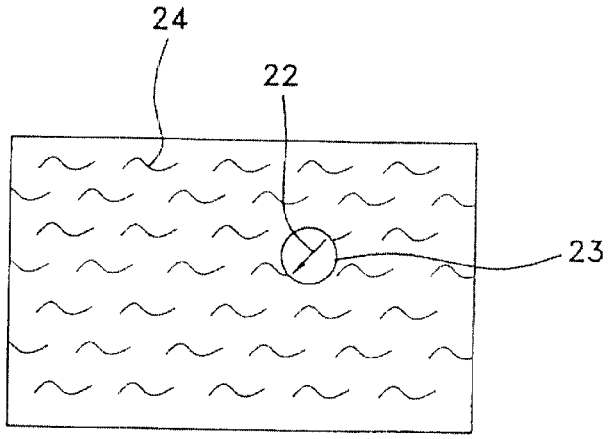
FIG. 7 is a conceptual diagram illustrating the magneto-rheological fluid according to the present invention.
Figure 10A:
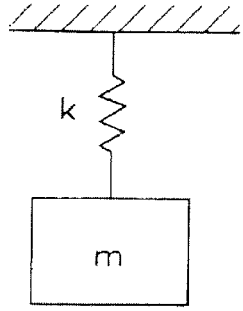
FIGS. 10A and 10B are schematic views of a vibration speaker according to the prior art and the present invention, respectively.
Figure 10B:
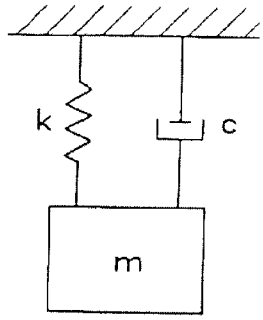
Figure 8:
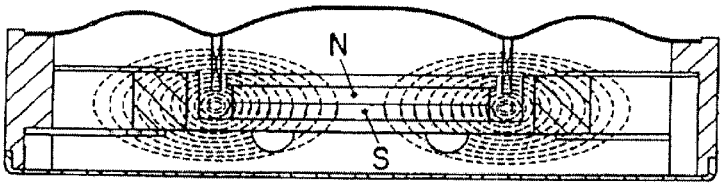
FIG. 8 is a diagram illustrating formation of a magnetic field according to the present invention.

The magneto-rheological fluid 21 added during the vibration serves to prevent the touching phenomenon with a damping effect, as shown in FIGS. 5 and 6.

FIG. 5 is a configuration of an initial coating of the magneto-rheological fluid on the yoke 35. FIG. 6 is a configuration of the magneto-rheological fluid when a low frequency signal (preferably of 100–200 Hz) is applied to the coil 45 for generating a vibration and the vibrating mass including the parts constituting the magnetic field suspended on the suspension springs 37, 39 is moving downward. The magneto-rheological fluid operates between the lower surface of the yoke and an upper tip of the coil for generating a vibration.

Figure 9:
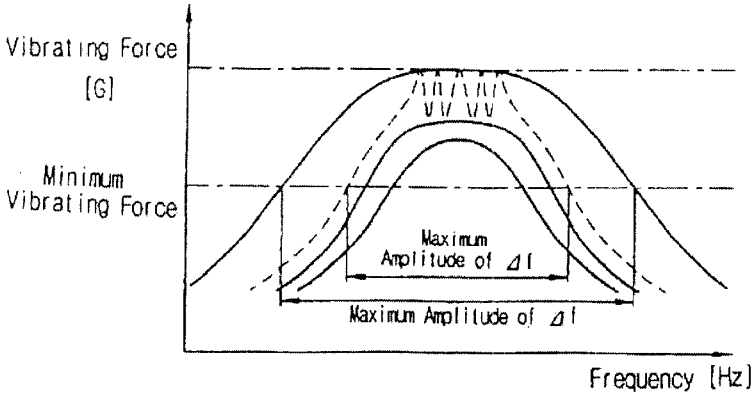
FIG. 9 is a graph illustrating vibrating characteristics variable in accordance with increased intensities of an input signal.

Accordingly, it is possible to increase the intensity of the inputted vibrating signals. Also, as shown in FIG. 9, the frequency bandwidth that can secure a minimum vibrating force, i.e., the inputted frequency bandwidth, is widened, thereby generating a consistent vibrating force for a set, on which a device such as a cellular phone or a pager is mounted. The bandwidth of the frequency is greatly magnified by increasing the intensity of the input signals for generating a vibration. As a result, the material cost can be reduced and high productivity can be achieved due to a released standard size of the product when assembling the parts related to the vibrating characteristics.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A vibration speaker comprising:

a case having a space therein;

a vibrating plate having a portion fixed onto the case for generating a sound;

a voice coil wound and fixed onto the vibrating plate in a cylindrical shape;

a plate having an external end portion fixed onto a lower end portion of the case;

a magnetic circuit which includes a magnet seated in a vertical direction, an upper plate and a yoke attached to the magnet for forming a magnetic field, the magnetic circuit including a bottom surface opposed to the plate;

a suspension mechanism fixed onto the case for suspending the magnetic circuit; and a magneto-rheological fluid having a predetermined degree of viscosity arranged between the magnetic circuit bottom surface and the plate so as to be capable of contacting both to function as a damping member while the suspension mechanism is displaced in a vertical direction.

2. The vibration speaker of claim 1, further comprising a coil for generating a vibration of the magnetic circuit by receiving a low frequency.

3. A vibration speaker comprising:

a case having a space on an inner surface thereof;

a case having a space therein;

a vibrating plate having a portion fixed onto the case for generating a sound;

a voice coil wound and fixed onto the vibrating plate in a cylindrical shape;

a plate having an external end portion fixed onto a lower end portion of the case;

a magnetic circuit which includes a magnet seated in a vertical direction, an upper plate and a yoke attached to the magnet for forming a magnetic field, the magnetic circuit including a bottom surface opposed to the plate;

a suspension mechanism fixed onto the case for suspending the magnetic circuit and a weight; and a magneto-rheological fluid having a predetermined degree of viscosity arranged between the magnetic circuit and the plate to function as a damping member while the suspension mechanism is displaced in a vertical direction;

wherein the magneto-rheological fluid is coated on a lower surface of the yoke causing a displacement in a vertical direction by being integrated with the weight so as to operate between the yoke and the plate.

4. A vibration speaker comprising:

a case having a space on an inner surface thereof;

a case having a space therein;

a vibrating plate having a portion fixed onto the case for generating a sound;

a voice coil wound and fixed onto the vibrating plate in a cylindrical shape;

a plate having an external end portion fixed onto a lower end portion of the case;

a magnetic circuit which includes a magnet seated in a vertical direction, an upper plate and a yoke attached to the magnet for forming a magnetic field the magnetic circuit including a bottom surface opposed to the plate;

a suspension mechanism fixed onto the case for suspending the magnetic circuit and a weight; and a magneto-rheological fluid having a predetermined degree of viscosity arranged between the magnetic circuit and the plate to function as a damping member while the suspension mechanism is displaced in a vertical direction;

further comprising a coil for generating a vibration by receiving a low frequency;

wherein the magneto-rheological fluid is coated on a lower surface of the yoke causing a displacement in a vertical direction by being integrated with the weight so as to operate between the yoke and the coil for generating a vibration positioned above the plate, which is located at a lower side of the case.

* * * * *